US005267665A

United States Patent [19]

Sanai et al.

[11] Patent Number: 5,267,665

[45] Date of Patent: Dec. 7, 1993

[54] HARDENED LUGGAGE CONTAINER

[75] Inventors: Mohsen Sanai, Palo Alto; Gary R. Greenfield, San Jose, both of Calif.

[73] Assignee: SRI International, Menlo Park, Calif.

[21] Appl. No.: 763,007

[22] Filed: Sep. 20, 1991

[51] Int. Cl.[5] ..... F42B 39/14

[52] U.S. Cl. ..... 220/88.1; 220/454; 220/444; 220/455; 428/34.7

[58] Field of Search ..... 428/920, 921, 902, 34.5, 428/34.6, 34.7, 35.9; 220/88.1, 88.2, 454, 444, 421, 420, 455; 109/15, 49.5; 89/1.1, 36.01; 102/303

[56] References Cited

U.S. PATENT DOCUMENTS

| | | | |
|---|---|---|---|
| 2,743,035 | 4/1956 | Fogarty | 220/88.2 |
| 2,803,368 | 8/1957 | Koch | 220/454 |
| 3,739,731 | 6/1973 | Tabor | 220/454 |
| 3,786,956 | 1/1974 | Tabor . | |
| 3,822,807 | 7/1974 | MacDonald | 220/88.1 |
| 4,027,601 | 6/1977 | Nickerson | 109/49.5 |
| 4,055,247 | 10/1977 | Benedick et al. . | |
| 4,225,278 | 9/1980 | Weiner | 220/486 |
| 4,237,182 | 12/1980 | Fulmer et al. | 264/45.3 |
| 4,248,342 | 2/1981 | King et al. . | |
| 4,328,901 | 5/1982 | Gunderman | 220/88.1 |
| 4,432,285 | 2/1984 | Boyars et al. . | |
| 4,463,465 | 8/1984 | Parker et al. | 5/459 |
| 4,632,041 | 12/1986 | Ohlson | 109/49.5 |
| 4,727,789 | 3/1988 | Katsanis et al. | 109/49.5 |
| 4,795,047 | 1/1989 | Dunwoodie . | |
| 4,879,165 | 11/1989 | Smith | 109/49.5 |
| 4,889,258 | 12/1989 | Yerushalmi | 220/454 |
| 4,898,104 | 2/1990 | Savoy et al. | 109/49.5 |
| 5,092,024 | 3/1992 | McGarvey | 220/88.1 |
| 5,102,723 | 4/1992 | Pepin | 428/902 |
| 5,103,651 | 4/1992 | Coelho et al. | 220/444 |

FOREIGN PATENT DOCUMENTS

| | | | |
|---|---|---|---|
| 2536231 | 2/1977 | Fed. Rep. of Germany . | |
| 3600693 | 7/1987 | Fed. Rep. of Germany | 109/49.5 |

*Primary Examiner*—Allan N. Shoap
*Assistant Examiner*—S. Castellano
*Attorney, Agent, or Firm*—Richard P. Lange; John S. Bell

[57] ABSTRACT

A bomb-resistant luggage container of this invention minimizes the effects of a bomb explosion by effectively containing the explosive shock wave and explosion debris, while allowing a controlled venting of detonation products. Methods of making the blast-resistant luggage container of this invention are disclosed. Methods of containing an explosion are disclosed. Methods of retrofitting existing non-blast-resistant luggage containers are also shown.

11 Claims, 5 Drawing Sheets

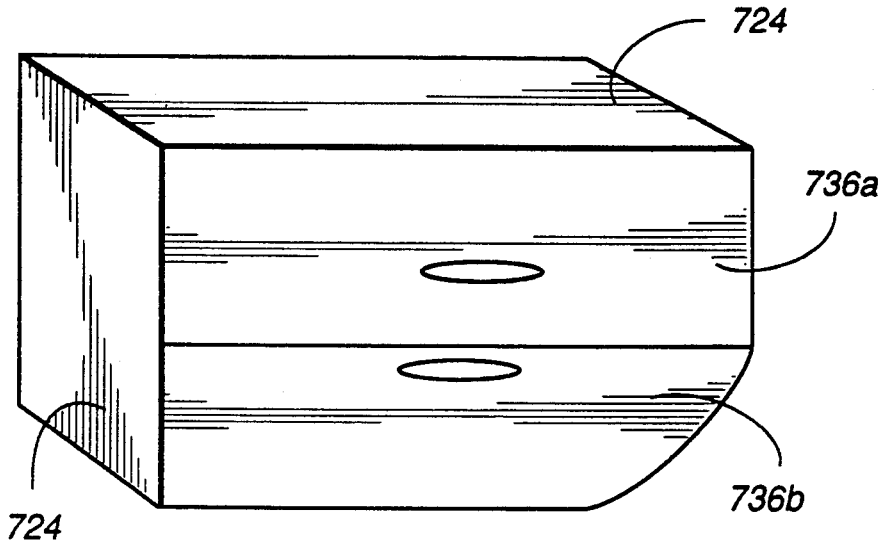
Figure 7a
Figure 7b
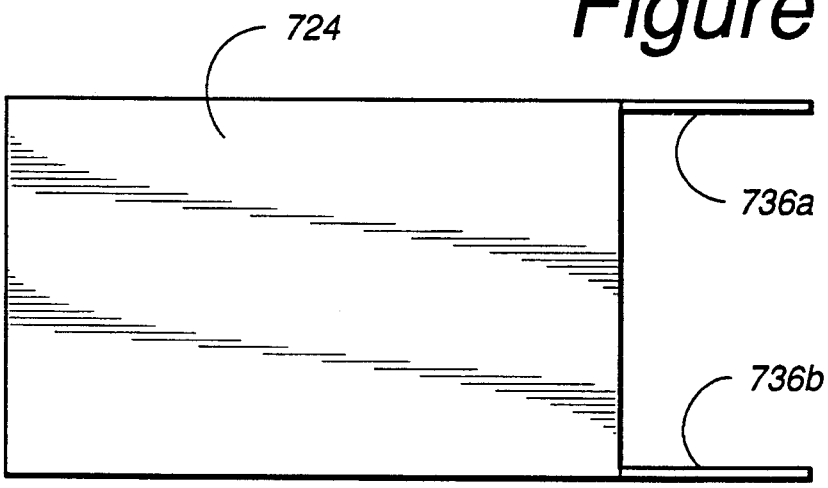
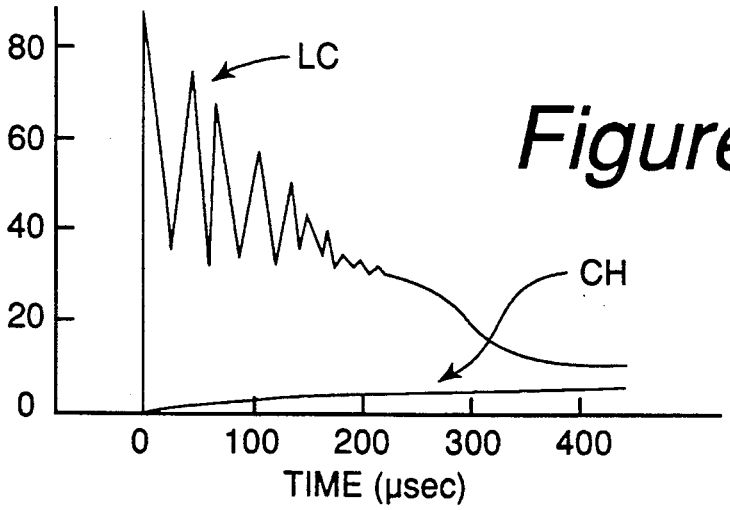
Figure 8

HARDENED LUGGAGE CONTAINER

TECHNICAL FIELD

This invention relates to containers for the storage and transport of items which may potentially contain an explosive device such as a bomb.

BACKGROUND ART

International terrorism has escalated in recent years. In 1990 a Pan Am jet exploded over Lockerbie, Scotland, killing all aboard. The explosion has been attributed to a terrorist bomb which was placed in the cargo hold.

U.S. Pat. No. 3,786,956 shows a laminated container for explosives. The container is capable of at least partially absorbing a detonation by delamination of the laminated walls. Explosives placed within the container are spaced from contact with the outer walls of the container by a support structure. The support structure can comprise, for example, a net, or a material such as plastic foam or foam rubber.

U.S. Pat. No. 4,055,247 shows an explosion containment device including three layers of steel and crushable layers intermediate to the steel layers.

U.S. Pat. No. 4,432,285 shows an aircraft explosive storage containment unit. The container acts to attenuate the effects of a bomb blast and direct the force of the explosion into a specific area. In use, the bomb is placed within the container, and the container is placed in a structurally non-sensitive portion of the airplane, with a least attenuating (failure mode) portion directing the blast effects outward through the aircraft hull.

The use of each of these explosive containment devices requires that an explosive device be identified. Once the bomb is identified, a person is placed at risk as they put the explosive within the containment device. The devices generally include large amounts of steel for blast containment, and thus are heavy. None of the devices are suitable for the enclosure and transport of large amounts of items such as luggage which may potentially contain an explosive device.

It would be desirable to provide a transport structure which is sturdy and relatively lightweight, can be used to containerize and transport luggage within an aircraft or other transportation means, and which is bomb-resistant or bomb-proof.

DISCLOSURE OF INVENTION

A blast-resistant luggage container of this invention minimizes the effects of a bomb explosion by effectively containing the explosive shock wave and explosion debris, while allowing a controlled venting of detonation products. The blast-resistant luggage container comprises a first end, a second end, and a tubular body section. The tubular body section includes, at a minimum, a debris capture layer and a pressure mitigation layer. Preferably, the body section comprises series of layers, each layer having a specific functionality. For example, the body section can comprise a first pressure mitigation layer affixed internal to a structural support layer, and a debris capture layer and an outer pressure mitigation layer external to the structural support layer. Alternate functional embodiments and laminate structures are presented. One or more rupture ports may be present. Fire retardant materials may be present within one or more of the layers.

Methods of making a blast-resistant luggage container of this invention are disclosed. Methods of retrofitting existing non-blast-resistant ("old style") luggage containers are given.

BRIEF DESCRIPTION OF DRAWINGS

FIG. 7 shows a bomb-resistant luggage container with articulated doors comprising one end piece of the container.

FIG. 8 demonstrates the pressure curves within and surrounding a bomb-resistant luggage container in which a bomb has exploded.

BEST MODE(S) FOR CARRYING OUT THE INVENTION

The explosion of a bomb includes two separate damage-causing phenomena: the detonation products; and the explosion debris. Each of these must be contained or controlled in the effects of the bomb blast are to be minimized.

The term "detonation products" refer to gases and the shock wave (a front of significantly increased pressure) which are produced during the explosion. The shock wave which radiates outward from the explosion site carries significant damage potential. The "explosion debris" includes solid materials such as fragments of the bomb and the material surrounding the bomb which are propelled outward by the bomb blast. The bomb-resistant luggage container of the subject invention includes components which are designed to contain and control the effects of the detonation products and of the explosion debris. "Explosive conditions" refer to the explosion of a bomb or other explosive device within a luggage container.

The Figures are drawn for clarity and are not drawn to scale. Similar numbers refer to similar structures throughout the Figures.

Figure 1A:
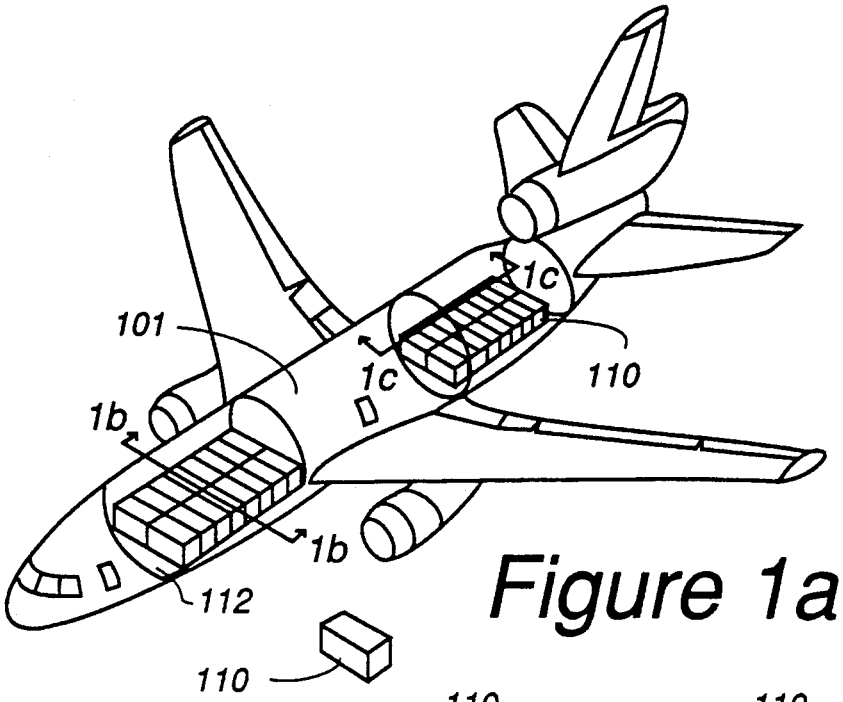
FIG. 1*a* shows the use of bomb-resistant luggage containers of this invention within an aircraft.

FIG. 1*a* shows the configuration of a DC-10 aircraft 101 (McDonnel-Douglas) with an upper-galley configuration. The body of the aircraft is cut away to show standard positioning of luggage containers 110 within the cargo hold 112. Passenger seating is located above the cargo hold 112.

The use of luggage carriers in an airport setting is relatively routine. Luggage is collected from passengers and tagged as to destination. If a physical or electronic search is done of the luggage, it is done before the luggage is loaded into a luggage carrier. Generally, no such search is done for domestic flights. Luggage on international flights may be searched or scanned, or a representative sample may be searched or scanned. Luggage from various passengers which is going to a single destination is loaded into a luggage carrier. The luggage carrier is then loaded onto an aircraft going to that destination.

Figure 1B:
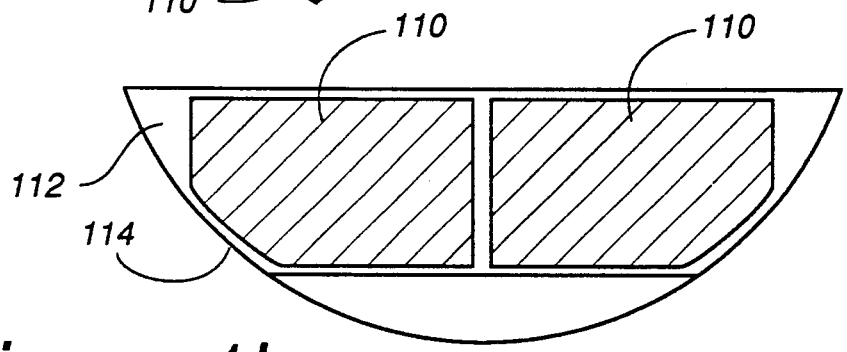
FIG. 1*b* is a cutaway view of the luggage containers shown in FIG. 1*a* taken through line 1*b*—1*b*.
Figure 1C:
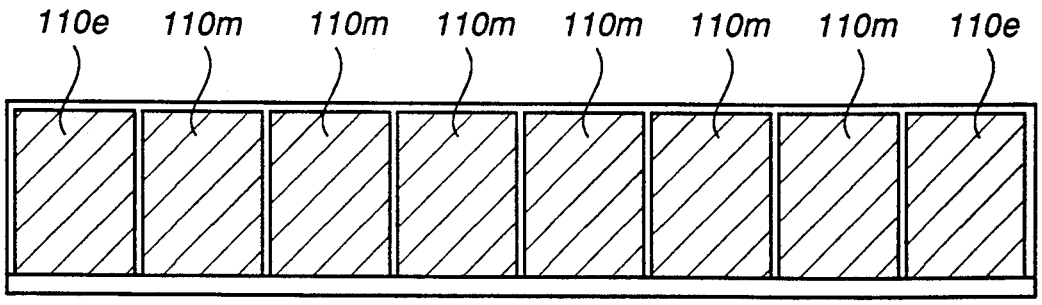
FIG. 1*c* is a cutaway view of the luggage carrier shown in FIG. 1*a* taken through line 1*c*—1*c*.

As shown in FIGS. 1*a*, 1*b* and 1*c*, luggage carriers are packed tightly and efficiently within the cargo hold 112. FIG. 1*b* shows a cross-sectional view of two luggage carriers 110 within the cargo hold 112 taken through line 1*b*—1*b* of FIG. 1*a*. In an effort to maximize the effectively used space, one corner of the body of the luggage carrier 110 is generally manufactured to conform to the aircraft hull 114.

FIG. 1*c* shows a cross-sectional view of a row of eight luggage carriers taken through line 1*c*—1*c* of FIG. 1*a*. The effect of a bomb explosion within one of these luggage carriers is very different when reinforced luggage containers are used than when luggage containers of the subject invention are used.

For example, when a bomb is placed within an unreinforced luggage carrier in a row such as that shown in FIG. 1*c*, and detonated, the detonation products and debris impact the hull of the cargo hold 112 from each of the three exposed sides. The explosion products are absorbed on three sides by the luggage carriers adjoining the one which contained the bomb.

In contrast, when a bomb is placed within a reinforced luggage carrier of this invention 110 m within the row, and detonated, the detonation products and debris are contained within the body of the bomb-resistant luggage container at each of the three exposed sides. The explosion products are absorbed at the two ends by the luggage carriers adjoining the one which contained the bomb.

The bomb-resistant luggage containers of the subject invention are preferably constructed to fit the standard size and durability parameters of luggage containers which are widely used by the airline industry. The weight of the bomb-resistant luggage containers will vary depending upon the specific materials used, and the specific blast parameters which the container is designed to safely enclose. Generally, the more bomb-resistant the luggage container is, the more it will weigh. However, luggage containers built in accordance with the disclosure herein can be manufactured to be relatively lightweight and yet withstand an exploding device containing an equivalent of 3 lb. (1.4 kg) high explosive.

The specific configuration of a bomb-resistant luggage container of this invention is not critical. Generally, a preferred configuration provides a luggage container designed to provide quick and easy access to the stored luggage. It is also designed to withstand being moved by truck, crane, forklift, elevators, escalators, and the like, without undue structural damage to the container or its contents. The luggage within the container should remain within the container even if the container is accidentally dropped or otherwise subjected to rough handling.

Figure 2:
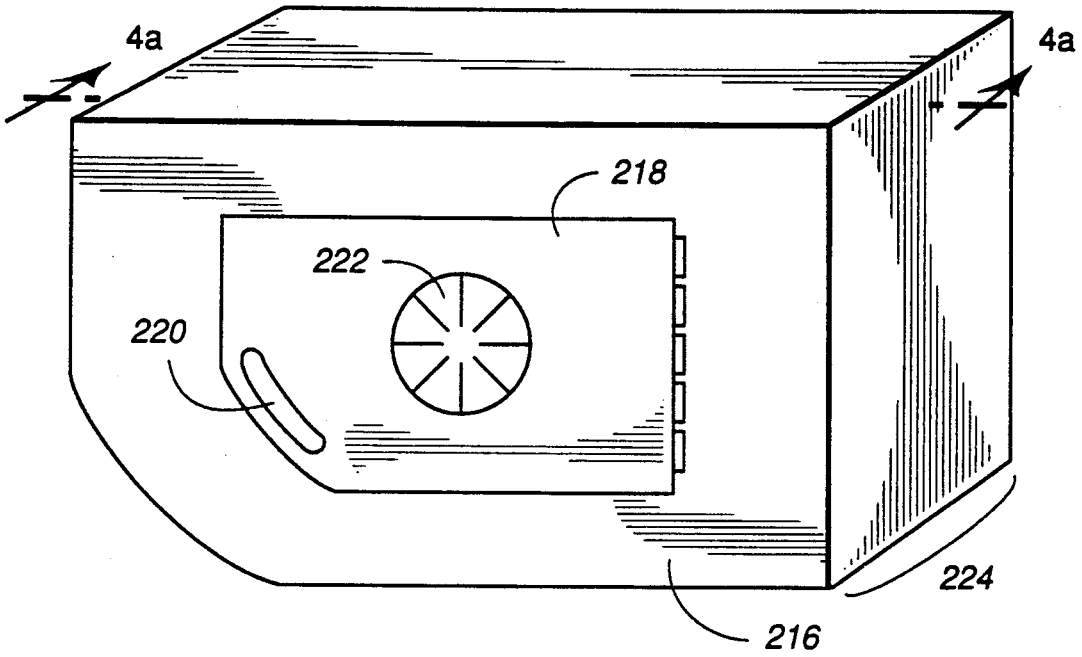
FIG. 2 shows a bomb-resistant luggage container of this invention.

FIG. 2 shows the external configuration of one bomb-resistant luggage container 210 of this invention. The luggage container has a first end 216 which includes a hinged door 218, a handle means 220, and a rupture port 222. Opposite the first end 216 is the second end (not shown). The second end can be substantially similar to the first end and provide access to the interior of the container. Alternatively, the second end can be solid, so that access to the interior is only through the door on the first end.

Figure 6:
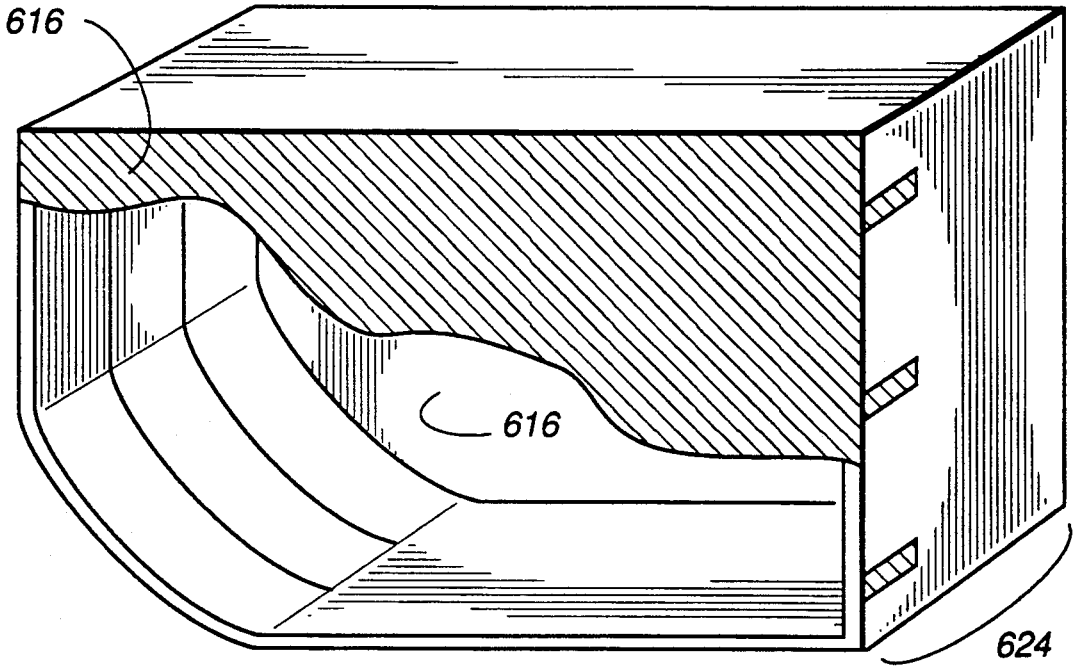
FIG. 6 shows a partially cutaway view of a bomb-resistant luggage container having flexible tear-resistant end pieces.

The first and second ends can comprise solid fixed or removable panels, especially panels made of aluminum or other metals, polymer, plastic, and the like. Alternatively, the ends can comprise a fabric panel which is secured in position (as shown in FIG. 6). The first and second ends can be substantially similar, or they can be substantially different in materials or design. At least one of the first and second end provides access to the interior of the container. If a hinged door 218 is present, the door can have any desired physical parameters and attributes. For example, the door 218 can be hinged, or pivotal on any axis, or it can be removable. A multiplicity of doors (two, as shown in FIG. 7, or more) can be present. Similarly, the handle means 220 can be easily varied to any desired configuration, or omitted altogether.

A rupture port 222 can be present in one or both ends of the luggage container. The rupture port 222 acts as a preferred failure mode under explosive pressure. Various types and configurations of rupture ports are known in the art. For example, an aluminum door or wall can include a scored or pre-weakened area which will rupture prior to the rupture of the remainder of the wall. Alternatively the door can include a large circular port that is covered with an impulse sensitive diaphragm. The diaphragm is prescarred along the radius at several locations so that the diaphragm ruptures when the pressure inside the container exceeds a threshold value for a specified duration. The ratio of the venting area to the container volume as well as the strength and thickness of the rupture diaphragm can be adjusted to achieve the desired level of confinement of the detonation products.

Because the body portion of the luggage container is a generally rounded tube under explosive force, the explosion pressure and debris which are not absorbed by the body portion are forced generally axially along the length of the tube, toward and/or through the end pieces. To provide maximum aircraft protection from bomb damage, the bomb-resistant luggage containers are arranged side by side with the end piece of each unit adjacent the end piece of the next unit. To minimize risk, the containers placed next to the aircraft walls should be filled with suitcases which have been thoroughly checked before the flight, or with materials such as factory-sealed products or sealed mail bags. In this configuration, an explosion which occurs in an inner bomb-resistant luggage containers is contained largely within the unit in which the explosion occurred. Physical debris which escapes is contained largely within the units surrounding the unit in which the explosion occurred.

The body section 224 of the blast-resistant luggage container is a generally tubular structure, i.e., has a cross-sectional shape and a length. The specific cross-sectional outline of the tubular structure prior to an explosion is not critical. For example, as shown in FIG.

Figure 3:
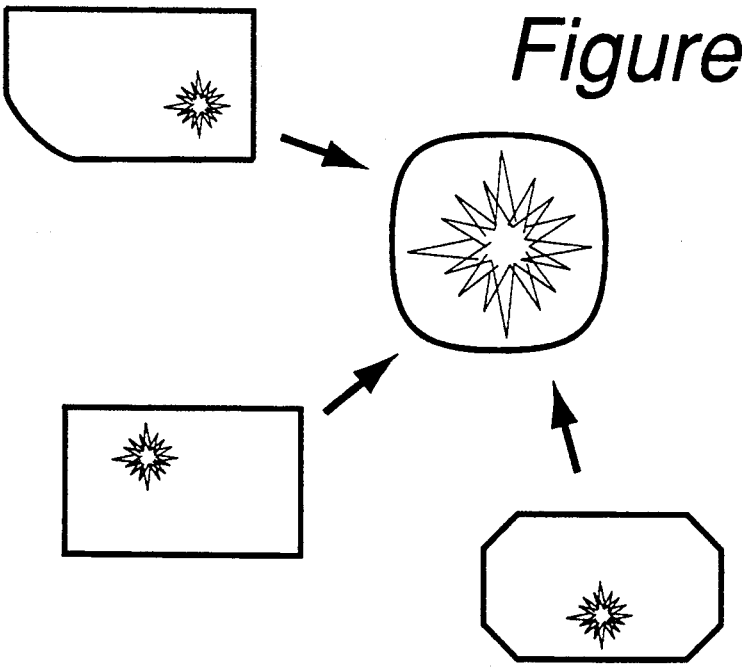
FIG. 3 shows the effects of explosive conditions upon cross-sectional configurations of variously configured bomb-resistant luggage containers.

3, the body section can be rectangular partially or approximately rectangular having one or more corners replaced by an additional side, eccentric, or square in cross-section prior to an internal explosion. The cross-sectional shape can be designed for convenient use in the specific application. Under explosive force propagating as shown in FIG. 3 in all directions from a bomb or other explosive device toward the walls of the luggage container. However, the body section of the blast-resistant luggage container becomes substantially round or circular in cross-section as shown in FIG. 3. As is also shown in FIG. 3, detonation of an explosive device such as a bomb that projects detonation products outwardly in substantially all directions will cause the tubular body section of the luggage container to assume a round configuration even though the bomb is not located at the center of the container. This round cross-section provides hoop strength, and minimizes the potential failure modes of the luggage container. Other cross sectional shapes (not shown) which may find use include circular, oval, triangular, hexagonal, and the like.

The bomb-resistant luggage container includes at least one pressure mitigation layer which is tubular when expanded, for example by explosion. When only one such pressure mitigation layer is present, it is the outermost layer. The pressure mitigation layer acts to contain, and slowly vent, the detonation products and pressure variations. The inner layer (or series of layers) is a debris restraining layer. The debris restraining layer acts to contain solid materials which are propelled outward by the bomb blast, and acts to provide structural integrity to the luggage carrier unit. A structural support layer or mechanism can be present. Alternatively, the debris restraining layer(s) acts as the structural support.

FIG. 4 depicts alternate layer structures which make up the body portion of a bomb-resistant luggage container. The multi-layered structure shown in FIG. 4*a* is a currently preferred embodiment. It includes, sequentially, an outer pressure mitigation layer 426, a structural supporting layer 428, an inner foamed offset layer 430, and an inner pressure mitigation layer 432. In this preferred embodiment, the structural supporting layer 428 the foamed offset layer 430 act together to form the debris capture layer 434.

The outer pressure mitigation layer 426 is a flexible, flow-through sheet, preferably having a relatively thin cross-section. The outer pressure mitigation layer 426 takes a tubular shape, open at each end but seamless throughout the body of the container. The purpose of the pressure mitigation layer is to allow the detonation products to vent slowly through, while the debris restraining layer encloses all or most of the solid debris generated by the explosion. The outer pressure mitigation layer 426 preferably also acts to enclose any solid debris which is not completely enclosed by the debris restraining layer. The pressure mitigation layer is made of a strong, light, high-density material such as Kevlar polymeric wool, fiberglass, manila rope, metal or metallized threads, or a plastic such as polypropylene or nylon. The sheet can be felted or woven, for example. The sheet can be constructed using one or more perforated or porous layers. When the tubular sheet includes multiple layers, each layer can be a tubular structure. Alternatively, the layered material can be generally spirally wrapped ("mummy-wrapped") into a tubular form. The spiral wrap includes sufficient overlap of the sheets that the layer functions as a seamless tube under explosive conditions.

The debris capture layer 434 has the function of containing the maximum amount of debris possible within design parameters. By containing blast debris the debris capture layer 434 acts to protect the outer mitigation layer 426 from damage, as well as protecting the surrounding area from such debris. In a preferred embodiment, the debris capture layer 434 comprises separate layers for structural support and for blast containment.

Figure 4A:
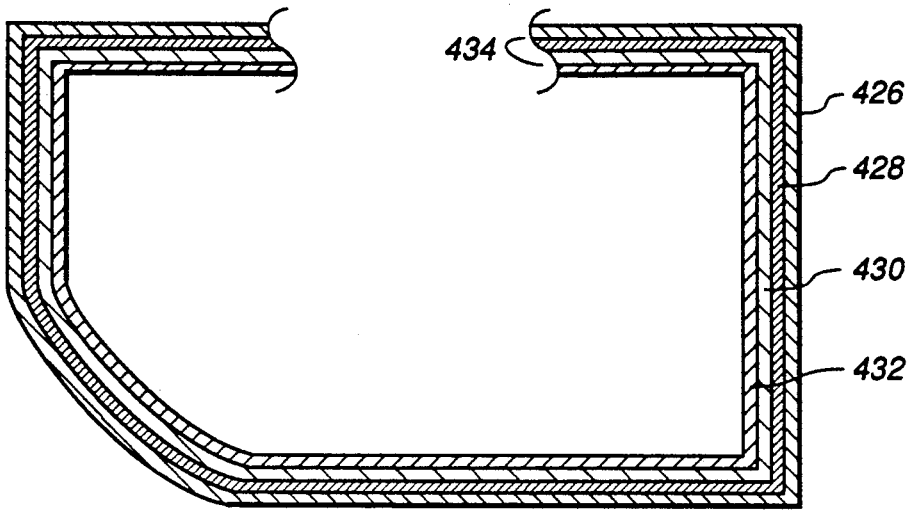
FIG. 4*a* shows a diagrammatic cross sectional view of the luggage carrier of FIG. 2 taken at line 4*a*—4*a*.
Figure 5:
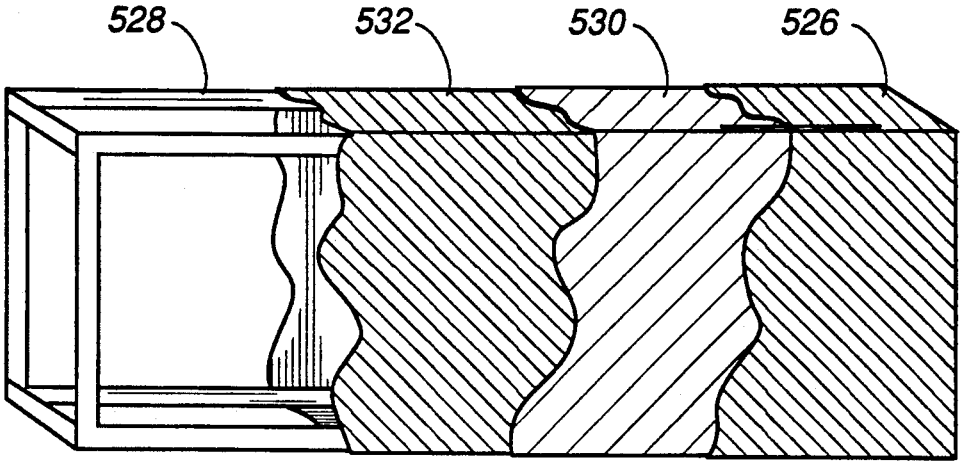
FIG. 5 shows a progressive cutaway view of a bomb-resistant luggage container having a frame that provides structural support along the edges of the container.

The supporting layer 428 in the preferred embodiment shown in FIG. 4*a* comprises a luggage carrier made, for example, from a metal such as aluminum, titanium or steel; from a polymeric or plastic material, or from a composite such as carbon fiber or fiberglass. Such luggage carriers are available commercially, such as those from Alusingen GmbH (Singen, Germany). A commercially available luggage carrier can be retrofitted to provide the bomb resistant qualities of the subject invention. Alternatively, a supporting structure or layer 428 can be manufactured. (Designs which provide structural support only at the edges of the luggage container, or only along the body of the luggage container, are shown in FIGS. 5 and 6.)

The outer pressure mitigation layer 426 is designed not to fail in tension as it resists the blast pressure and the outward motion of the debris. However, it can be ruptured locally if a sufficiently large explosive charge is in a suitcase placed by chance next to the container wall. The offset layer 430, a low-density foam layer present in a preferred embodiment, provides a standoff distance between the charge and the outer pressure mitigation layer 426. This offset layer may be formed from a foam having either a closed pore or an open pore structure. The standoff provided by the offset layer 430 allows the detonation gases to expand and drop in pressure somewhat before they reach the container wall. Compression of the foam also absorbs part of the energy and softens the impact of the detonation gases on the outer portions of the container wall. Given a large enough explosive charge, the container wall will deform severely, and perhaps even rupture, in the area closest to the detonation center. The offset layer 430 is designed to ensure that the rupture hole grows slowly and the outer pressure mitigation layer 426 is not punctured prematurely.

Located interior to the offset layer 430 in FIG. 4*a* is the inner pressure mitigation layer 426. Like the outer pressure mitigation layer 426, the inner pressure mitigation layer 432 is a flexible, flow-through sheet, preferably having a relatively thin cross-section. The inner pressure mitigation layer 432 takes a tubular shape, open at each end but seamless throughout the body of the container. Due to its location within the luggage container, it provides the first layer of protection upon bomb detonation. Because it is unshielded from blast debris, it may be pierced by flying debris (shrapnel). Piercing the inner pressure mitigation layer 432 reduces its ability to absorb and prolong the effects of shock waves. The inner pressure mitigation layer 432 acts together with the debris restraining layer(s) to enclose bomb debris while it mitigates the effects of the detonation products.

Like the outer pressure mitigation layer 426, the inner pressure mitigation layer 432 is made of a strong, light, high-density material such as Kevlar® polymeric wool, fiberglass, manila rope, metal or metallized threads, or a plastic such as polypropylene or nylon.

The sheet is porous, and can be felted or woven from strands of material, or comprise one or more perforated layers. When the tubular sheet includes multiple layers, each layer can be a tubular structure. Alternatively, the layered material can be generally spirally wrapped ("mummy-wrapped") into a tubular form. When two or more pressure mitigation layers are present (for example, an inner pressure mitigation layer and an outer pressure mitigation layer), they can be substantially similar in materials and structure, or they can be substantially dissimilar.

The preferred embodiments of a bomb-resistant luggage container of this invention include appropriate features to resist fire. For example, if a foam offset layer is present, it can be made of a fire-proof material. Standard pressure or temperature-activated fire extinguisher pellets can be included within the foam layer to control any fire and prevent it from spreading into other areas.

The various layers which comprise the luggage carrier can be held together by chemical bonding agents (such as glues or hardening agents, tape, and the like); by physical means (such as bolts and nuts, wires, screws, and the like); by pressure fitting (especially, for example, to attach an outer pressure mitigation layer 428 to the remainder of the structure); by molding of the pieces so that a close fitting is achieved; or using any other available means or combination of means. It is preferred that the outer pressure mitigation layer 428 and the inner pressure mitigation layer 432 (if present) include the minimum number of potential flaws. It is therefor preferable that pressure mitigation layers be affixed by chemical bonding, by pressure fit, or by molding of the parts, rather than by any means which provides a weakened area under explosive conditions.

Figure 4B:
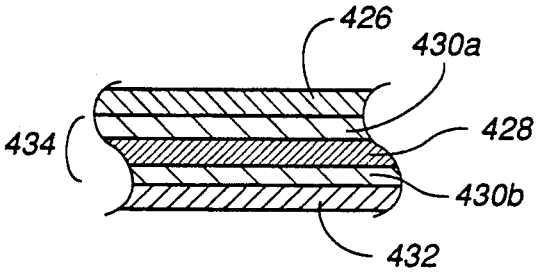
FIG. 4*b* shows an alternate body structure in cross sectional view that includes an additional offset layer.

FIG. 4*b* shows an alternate body structure in cross-sectional view. The outer pressure mitigation layer 426 is present. The debris capture layer 434 comprises three separate layers: the outer offset layer 430*a*, the supporting layer 428, and the inner offset layer 430*b*. The inner pressure mitigation layer 432 provides the innermost layer.

Figure 4C:
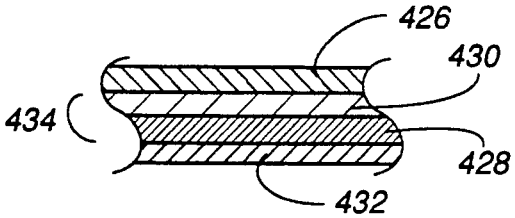
FIG. 4*c* shows an alternate body structure with a different arrangement of the layers illustrated in FIG. 4*a*.

FIG. 4*c* shows another body structure in cross-sectional view. An outer pressure mitigation layer 426 is present. The debris capture layer 434 comprises two separate layers: the offset layer 430 and the supporting layer 428. The inner pressure mitigation layer 432 provides the innermost layer.

Figure 4D:
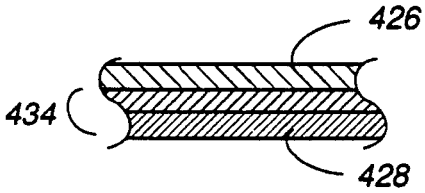
FIG. 4*d* shows another alternate body structure that omits the innermost pressure mitigation layer included in FIG. 4*a*.

FIG. 4*d* shows another alternate body structure in cross-sectional view. An outer pressure mitigation layer 426 is present. The debris capture layer 434 comprises two separate layers: the offset layer 430 and the supporting layer 428.

Figure 4E:
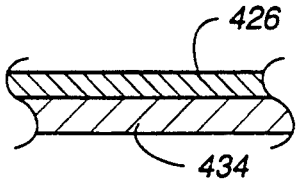
FIG. 4*e* shows another alternate body structure.

FIG. 4*e* shows another alternate body structure in cross-sectional view. An outer pressure mitigation layer 426 is present. The debris capture layer 434 provides both debris retention and structural functions.

Figure 4F:
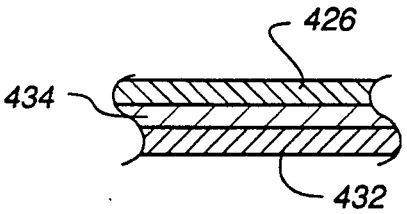
FIG. 4*f* shows yet another alternate body structure.

FIG. 4*f* shows yet another alternate body structure in cross-sectional view. An outer pressure mitigation layer 426 is present. The debris capture layer 434 provides both debris retention and structural functions. An inner pressure mitigation layer 432 provides the innermost layer.

FIG. 5 shows a progressive cut-away view of an alternate embodiment of the bomb-resistant luggage carrier of this invention. A frame 528 provides structural support only along the edges of the luggage container. Materials which are appropriate for the frame include metals such as aluminum and titanium, rigid plastics, and the like. Surrounding the frame 528 are an inner pressure mitigation layer 532, a foamed debris capture layer 530, and an outer pressure mitigation layer 526. End pieces (not shown) are attached to the frame 528.

FIG. 6 shows an alternate embodiment of the bomb-resistant luggage carrier of this invention. The body section 624 is rigid. The end pieces 616 are made of a tear-resistant materials (such as canvas, polymer or fiberglass-reinforced fabric, and the like) are attached firmly to the body section 624 using straps, hook-and-loop fasteners (velcro), buckles, or the like.

FIG. 7*a* shows another embodiment of the bomb-resistant luggage carrier of this invention. The end piece of the luggage carrier comprises two doors 736*a* and 736*b*. The body section 724 and the doors are articulated to provide access into the interior of the luggage container. FIG. 7*b* shows the luggage carrier of FIG. 7*a* in side view, with the doors open.

EXAMPLE 1

Manufacturing a Bomb-Resistant Luggage Carrier

To manufacture a bomb-resistant luggage container of the subject invention: a generally cubic aluminum frame is created. The frame has a height of approximately 64 inches (1.6 meters), a width of approximately 60 inches (1.5 meters), and a length of approximately 79 inches (2.0 meters). 1/32 inch (0.8 mm) thickness aluminum sheets are fastened (for example, by riveting or using metal screws) on the four sides along the length of the frame, and on one of the ends of the frame. An aluminum door is fixed to the remaining end.

A 2 inch thick (5.1 cm) layer of flame-retardant urethane sheets is affixed to the interior of the aluminum frame using an adhesive.

A perforated sheet of Kevlar is mummy-wrapped (spiral wrapped) to cover the outside of the aluminum frame to a depth of three thicknesses. The sheet of Kevlar is approximately 100 mils (2.7 mm) thick, for a total thickness of about 300 mils (8 mm) when wrapped around the frame. The wrapped Kevlar layer extends the outer length of the luggage carrier. The sheet of Kevlar includes perforations, each perforation having a diameter of less than about ⅛ inch (0.3 cm). The total area of the sheet includes approximately 70% Kevlar, and approximately 30% perforations, with the perforations spread approximately evenly across the area of the sheet. Additional adhesive is used to affix the Kevlar to the outside of the aluminum frame as needed.

A internal tubular blanket, made of woven Nylon or propylene, is affixed to the inside of the foam layer using an adhesive. This inner tubular blanket is ¼ inch (0.6 cm) thick and extends the inner length of the luggage carrier.

EXAMPLE 2

Retofitting a Non-Blast Resistant Luggage Carrier

To retrofit a non-blast-resistant luggage container: an LD3 luggage container is obtained from Alusingen GmbH (Singen, Germany). A 2 inch thick (5.1 cm) layer of flame-retardant urethane sheets is affixed to the interior of the aluminum frame using an adhesive.

A tubular blanket made of woven Kevlar is affixed by pressure fit to the outside of the aluminum structure. This outer tubular blanket is ¼ inch (0.6 cm) thick, and covers the length of the aluminum structure.

An inner tubular blanket made of woven Kevlar is affixed to the inside of the foam sheet layer using an adhesive. This inner tubular blanket is ¼ inch (0.6 cm) thick, and covers the inside length of the structure.

EXAMPLE 3

Manufacturing a Bomb-Resistant Luggage Carrier

To manufacture a bomb-resistant luggage container of the subject invention: a generally cubic aluminum frame is created. The frame has a height of approximately 64 inches (1.6 meters), a width of approximately 60 inches (1.5 meters), and a length of approximately 79 inches (2.0 meters). 1/32 inch (0.8 mm) aluminum sheets are fastened (for example, by riveting) on the four sides along the length of the frame, and on one of the ends of the frame. An aluminum door is fixed to the remaining end.

A tubular blanket made of woven Kevlar is affixed by pressure fit to the outside of the aluminum structure. This outer tubular blanket is ¼ inch (0.6 cm) thick, and covers the length of the aluminum structure.

EXAMPLE 4

Bomb Explosion within an Unreinforced Luggage Carrier

A 3 lb. (1.4 kg.) high explosive charge is placed in luggage and loaded into a standard (non-bomb-resistant) luggage container. The luggage container has a volume of about 158 $ft^3$ (5.6 $m^3$). The luggage container is loaded onto a DC-10 aircraft, and the aircraft takes flight. The bomb is detonated. A high-pressure shock wave carries debris from the bomb and from surrounding luggage against the side walls of the unreinforced luggage carrier. The luggage carrier is destroyed, with failure occurring along the seams at which the luggage carrier walls are joined. The panels are deformed and separate, and the pressure wave and debris exit the container substantially unabated. The structural walls of the aircraft are impacted by the shock wave and debris, causing potential rupture of the structural walls and aircraft failure.

EXAMPLE 5

Bomb Explosion within a Reinforced Luggage Carrier

A 3 lb. (1.4 kg.) high explosive charge is placed in luggage and loaded into a bomb-resistant luggage container of Example 1. The bomb-resistant luggage container is loaded onto a DC-10 aircraft, and the aircraft takes flight. The bomb is detonated. A high-pressure shock wave carries debris from the bomb and from surrounding luggage against the side walls of the reinforced luggage carrier. The bomb-resistant luggage carrier contains the explosion within its body. FIG. 8 shows the calculated effects caused by the explosion. The curve designated LC shows large oscillations inside the bomb-resistant luggage container due to reverberation of the detonation wave. Controlled venting of the detonation products reduces the pressure within the cargo hold (curve CH) and extends by several orders of magnitude the duration over which the explosion impulse is applied to the aircraft structural shell. No shock loading occurs outside the bomb-resistant luggage container, so the pressure inside the aircraft luggage compartment increases slowly as the detonation products are venting out. The pressure inside the cargo hold rises slowly to no more than about 3 psi. This pressure is much less than the maximum pressure which such aircraft hulls are designed to withstand. With the severe initial shock environment mitigated by the bomb-resistant luggage container, the pressure which builds up inside the luggage compartment can be vented out through passive rupture ports, if present.

While the invention has been described in connection with specific embodiments thereof, those skilled in the art will recognize that various modifications are possible within the principles described herein. Such modifications, variations, uses, or adaptations of the invention, including such departures from the present disclosure as come within known or customary practice in the art, fall within the scope of the invention and of the appended claims.

We claim:

1. A lightweight container suitable for aircraft transportation of luggage that is blast-resistant to a predetermined explosive condition within the container, said container having a first end, a second end, and a body section of at least partially rectangular cross-sectional shape having at least four sides wherein said sides comprise a tubular wall having at least the following two layers:

(a) a debris capture layer; and (b) a pressure mitigation layer disposed outwardly from said debris capture layer, said pressure mitigation layer having sufficient flexibility to assume a substantially circular cross-sectional shape in response to said predetermined explosive condition within the container, sufficient tensile strength to provide hoop strength support in said rounded configuration for said debris capture layer, and said pressure mitigation layer having sufficient porosity to vent detonation products at a rate that provides pressure mitigation.

2. A container of claim 1 wherein said debris capture layer includes an offset layer comprised of lightweight foam, and a structural support layer comprised of a material selected from the group consisting of aluminum, titanium, steel, a polymeric material, a plastic material, a carbon fiber composite material, and fiberglass.

3. A container of claim 2 wherein said offset layer comprises a layer of lightweight, fire resistant urethane foam positioned inwardly from said structural support layer.

4. A container of claim 1 wherein said pressure mitigation layer is comprised of a lightweight porous material selected from the group consisting of fiberglass, polymeric material, synthetic material, metal cloth, and combinations thereof.

5. A container of claim 4 wherein:

said predetermined explosive condition within the luggage container vents detonation products from the container for a determinable time interval; and said pressure mitigation layer has a porosity that extends said time interval by at least an order of magnitude longer than venting in absence of said pressure mitigation layer.

6. A container of claim 4 wherein said porous pressure mitigation layer:

is formed from a high tensile strength synthetic material;

has approximately 70% of solid material and approximately 30% of perforations; and is spiral wrapped about the body section of the container in a direction to provide hoop strength support for said debris capture layer.

7. A container of claim 1 wherein the tubular wall further comprises a second pressure mitigation layer comprised of a material selected from the group consisting of fiberglass, polymeric material, synthetic material, metalized cloth, and combinations thereof disposed inwardly from said debris capture layer.

8. A container of claim 2 further including a second offset layer comprised of lightweight urethane foam disposed between said structural support layer and said pressure mitigation layer.

9. A container of claim 1 wherein:

said predetermined explosive condition comprises an explosion within the container that projects detonation gases, a shock wave, and explosive debris toward both said tubular wall and at least one of said ends;

said at least one end has a lower resistance to said explosion than said tubular wall; and said tubular wall has sufficient strength to direct the detonation gases, the shock wave, and the explosive debris toward said at least one end and vent from the container through said one end.

10. A container of claim 9 in which:

said predetermined explosive condition within the container comprises an explosion of an explosive device containing up to 3 pounds of a high explosive wherein said detonation gases, shock wave, and explosive debris propagate in substantially all directions from said explosive device;

said debris capture layer comprises an offset layer of lightweight urethane foam of a thickness of up to approximately 2 inches and an aluminum structural support layer of approximately 1/32-inch thick; and said pressure mitigation layer comprises up to approximately ⅛-inch thick layer of porous synthetic material.

11. A container of claim 10 wherein each layer of said tubular wall has sufficient strength and flexibility to assume said substantially circular cross section in response to said explosive force.

* * * * *